United States Patent [19]

van der Laan

[11] 4,327,524

[45] May 4, 1982

[54] WINDOW-FRAME HAVING A SASH-WINDOW ARRANGED IN IT

[75] Inventor: Jan G. van der Laan, Dieren, Netherlands

[73] Assignees: National Grondbezit N.V., The Hague; Agterhof Beheer N.V., Doetinchem, both of Netherlands

[21] Appl. No.: 126,049

[22] Filed: Feb. 29, 1980

[51] Int. Cl.[3] ..... E05D 13/02

[52] U.S. Cl. ..... 49/425; 49/408; 49/453

[58] Field of Search ..... 49/425, 420, 421, 438, 49/453, 408

[56] References Cited

U.S. PATENT DOCUMENTS

| | | | |
|---|---|---|---|
| 2,570,523 | 10/1951 | Clerk | 49/438 X |
| 2,917,792 | 12/1959 | Franzblau et al. | 49/438 |
| 3,304,658 | 2/1967 | Kreger | 49/425 |

FOREIGN PATENT DOCUMENTS

| | | | |
|---|---|---|---|
| 1230370 | 3/1960 | France . | |
| 1426046 | 3/1965 | France . | |
| 2298676 | 8/1976 | France . | |
| 1082209 | 9/1967 | United Kingdom . | |
| 1318702 | 5/1973 | United Kingdom | 49/453 |
| 1562227 | 3/1980 | United Kingdom | 49/425 |

*Primary Examiner*—Kenneth Downey
*Attorney, Agent, or Firm*—Allison C. Collard; Thomas M. Galgano

[57] ABSTRACT

A metal sash-window has been slidably arranged in a wooden window-frame without the intermediary of a metal window-frame mounted in the wooden window-frame.

3 Claims, 4 Drawing Figures

FIG.1
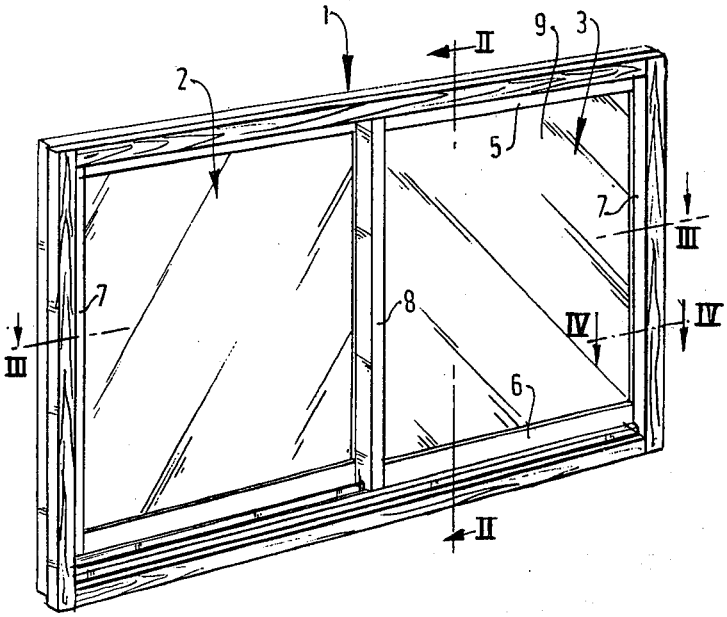
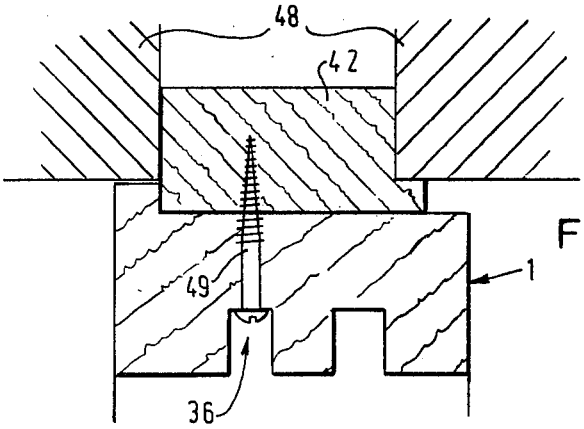
FIG. 4

WINDOW-FRAME HAVING A SASH-WINDOW ARRANGED IN IT

The invention relates to a window-frame having arranged therein at least one slidable sash-window, which mainly consists of a framework of metal, for example, aluminum and at least one glass plate mounted therein, said window-frame being made of wood and intended for direct mounting in a concrete or brick wall.

Such a window-frame is known. The sash-window is slidably arranged in a steel window-frame, which in turn is arranged in a wooden window-frame to be mounted in a building.

The invention has for its object to provide a simpler window-frame of the kind set forth in the preamble. According to the invention this is achieved in that the sash-window is provided at the top strip with at least one upper flange standing upright on the top side and engaging in a guide groove of the wooden lintel. The omission of the metal frame means an appreciable economy, whilst nevertheless perfect seal and simple mounting are obtained. For this purpose the upper flange has sealing brushes on both sides in the guide groove of the lintel.

The above-mentioned and further features of the invention will be described more fully hereinafter with reference to a drawing.

In the drawing:

FIG. 1 is a perspective view of a window-frame in accordance with the invention;

FIG. 4 is an enlarged sectional view of the a detail IV of FIG. 2, but of a different embodiment.

Figure 2:
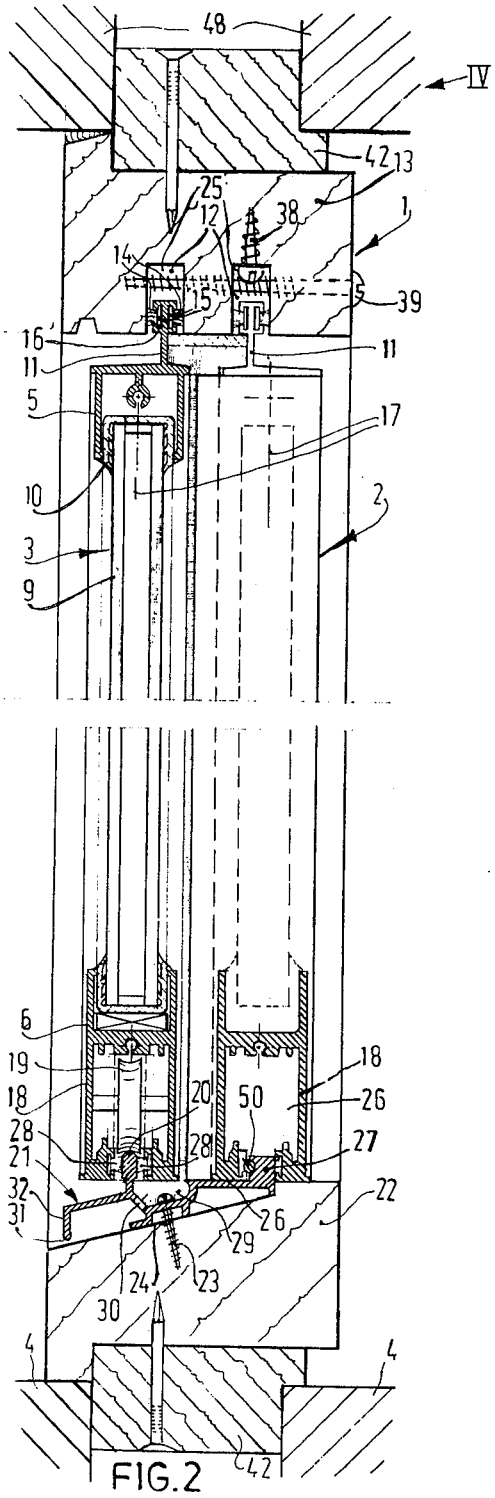
FIG. 2 is an enlarged sectional view taken along line II—II in FIG. 1.
Figure 3:
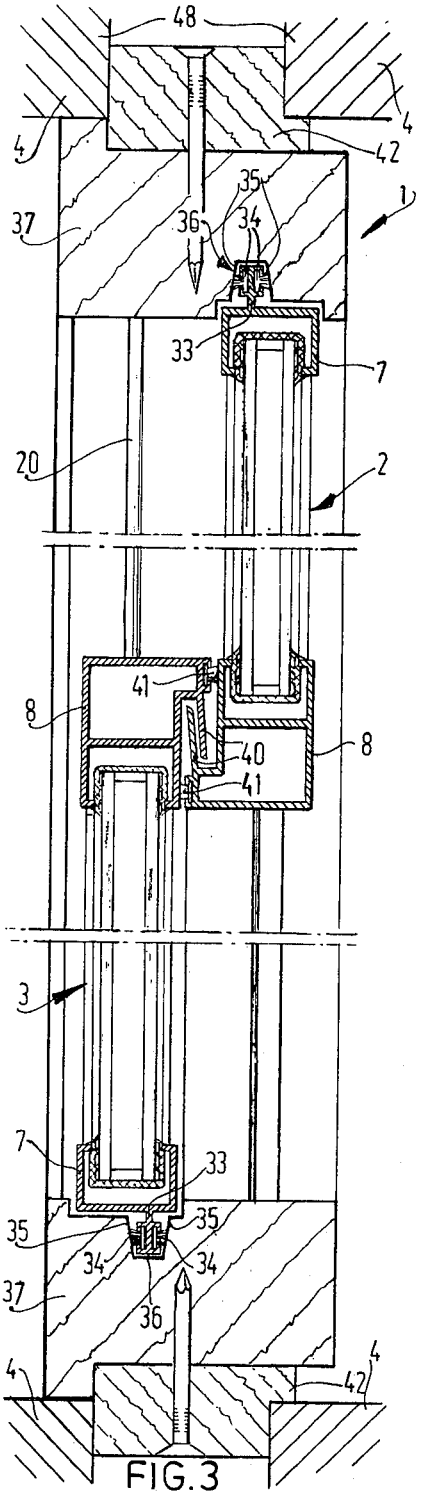
FIG. 3 is an enlarged sectional view taken along line III—III in FIG. 1.

Referring to FIGS. 1 to 3 the window-frame 1 according to the invention comprises a fixed window 2 and a sash-window 3. The window-frame 1 is made of wood, preferably hard wood and is directly mounted in a brick or concrete wall 4. Consequently instead of arranging first, as usual, a kind of setting frame in the wall 4, to which the window-frame 1 is secured, the window-frame 1 is mounted in direct contact with the bricks or the concrete of the wall 4. The sash-window 3 mainly comprises an outer framework of metal, preferably, aluminium, having an upper strip 5, a lower strip 6, a first side strip 7 and a second side strip 8. The framework of the sash-window 3 holds a glass plate 9 in an uninterrupted, elastic strip 10 of synthetic resin having a U-shaped profile and enclosed in an uninterrupted channel-section groove of the framework of the sash-window 3. The upper strip 5 has on the top side an upwardly extending upper flange 11 engaging in a guide groove 12 of the wooden lintel 13 and carrying on both sides sealing brushes 14 in the guide groove 12. To this end the upper flange 11 has grooves 15 for retaining brush bodies 16. The fixed window 2 has an identical upper strip 5, the upper flange 11 of which is in sealing relationship with a groove 12. The upper flange 11 of the sash-window 3 is arranged outside the longitudinal medium plane 17 of the sash-window 3, that is to say, on the side facing the fixed window 2. The upper flange 11 of the fixed window 2 is located nearer the sash-window 3 than the longitudinal medium plane 17 of the fixed window 2.

The lower strips 6 of the two windows 2 and 3 each have a sheath 18. In the lower sheath 18 of the sash-window 3 are rotatably journalled a plurality of wheels 19. The wheels 19 bear on a rail head 20 of a rail 21 fastened to a sloping upper surface 24 of a wooden lower ledge 22 of the window-frame 1 by screws 23. The rail 21 is secured by the screws 23 to the lower ledge 22. The fixed window 2 bears by its lower sheath 18 on a flange 26 of a supporting head 27, which like the rail head 20 forms part of the same rail 21. The lower sheath 18 of the sash-window 3 has a sealing brush 28 on either side of the rail head 20. The fixed window 2 is sealed by means of a sealing strip 50 between the supporting head 27 and the lower sheath 18. A gutter 29 receiving the screws 23 permits water to flow away via the holes 30 along a gap 31 beneath a front edge 32 of the rail 21. The two windows 2 and 3 can be readily inserted into the window-frame 1 by lifting the windows 2 and 3 above their working positions so that their upper flanges 11 extend high into the additional free spaces 25 of the grooves 12, after which they can be lowered on the supporting head 27 and the flange 26 respectively of the rail head 20.

Each window 2 and 3 has on a wall side a first side strip 7 with a side flange 33, which is in sealing relationship by means of sealing brushes 34 on either side thereof with the inclined faces 35 of a sealing groove 36 in the wooden jambs 37 of the window-frame 1. Above the windows 2 and 3 guard screws 38 and 39 respectively are provided for preventing lifting of these windows by thieves. The two first side strips 7 are identical. The two second side strips 8 are also identical and engage one another in sealing relationship by flanges 40 and with the aid of sealing brushes 41.

One and the same window-frame 1 may comprise several windows, for example, two sash-windows and one fixed window.

The window-frame 1 according to the invention described above can be manufactured at low cost, since its number of profiles is minimized. Moreover, the corresponding strips of the fixed window 2 and the sash-window 3 have identical profiles. Sealing against draught is achieved in a simple manner in grooves of the wooden window-frame 1.

It should be noted that each window may comprise two relatively spaced glass plates 9 rather than the single glass plate 9 mentioned above.

In order to prevent water from flowing from the lower ledge 22 into the corner joint of the wooden window-frame 1, the head sides of the aluminum rail 21 are provided with head partitions of synthetic resin (not shown).

The window-frame shown in FIGS. 1, 2 and 3 is a "brick-up" window-frame, which as shown in FIGS. 2 and 3 is arranged together with lathing 42 nailed to the wooden window-frame 1 in the wall 4 when the two partitions 48 of the cavity are built.

FIG. 4, however, illustrates the method of mounting of a so-called "build-in" window-frame 1. The lathing 42 is first inserted between the cavity partitions 48, if this lathing 42 is not yet present, and the window-frame 1 is fastened thereto by screws 49 or nails from the grooves 12 and 36.

What I claim is:

1. In a closure assembly of the type comprising: a wooden, generally rectangular frame adapted for direct mounting in a masonary wall, and composed of an upper lintel and a lower ledge joined by two side jambs, said frame also having arranged therein at least one slidable sash-window and another window, each of which includes a metal framework and at least one glass plate mounted therein, said sash-window having an upper strip and at least one upstanding upper flange coupled to said upper strip and engaging in a guide groove of said wooden lintel, said guide groove in said lintel having a free space above said upper flange, said sash-window also having a lower strip and a plurality of wheels rotatably arranged in said lower strip, said wheels running along a metal rail fastened to said wooden lower ledge of said frame, said sash-window also having at least one side strip with a side flange engaging in a sealing groove of said wooden jamb and another side strip with at least one flange engaging in its closing position in a U-profile of said other window for constituting a zig-zag shaped sealing space, the improvement comprising:

said upper flange carrying on both sides thereof sealing brushes in the guide grooves of said lintel, said side flange having sealing brushes on both its sides, said lower strip of the sash-window having sealing brushes on both sides of the rail head in sealing relationship with said rail head, and two sealing brushes for sealing the zig-zag shaped sealing space.

2. The closure assembly according to claim 1, wherein said upper flange is arranged outside the longitudinal medium plane of said sash-window adjacent to the side thereof facing the other window.

3. The closure assembly according to claim 1 or 2, wherein said rail bears on an inclined upper face of the lower ledge, and said rail is formed by an integral profile having a rail head cooperating with said wheels of said sash-window and a supporting head holding a fixed window, and said rail having a gutter arranged between the railhead and the supporting head, which is drained on the inclined upper surface of the lower ledge through holes arranged in the rail.

* * * * *